US007225942B2

(12) United States Patent
Song

(10) Patent No.: US 7,225,942 B2
(45) Date of Patent: Jun. 5, 2007

(54) OIL STORAGE TANK EQUIPPED WITH A FLOATING BED TYPE INNER FLOATING ROOF

(75) Inventor: Zhenqi Song, Room 1902, Building 20, Hua Qing Jia Yuan, Wu Dao Kou, Haidian District, Beijing 100084 (CN)

(73) Assignee: Zhenqi Song, Beijing (CN)

( * ) Notice: Subject to any disclaimer, the term of this patent is extended or adjusted under 35 U.S.C. 154(b) by 554 days.

(21) Appl. No.: 10/485,120

(22) PCT Filed: Aug. 6, 2002

(86) PCT No.: PCT/CN02/00542

§ 371 (c)(1),
(2), (4) Date: Feb. 5, 2004

(87) PCT Pub. No.: WO03/016178

PCT Pub. Date: Feb. 27, 2003

(65) Prior Publication Data

US 2004/0200835 A1 Oct. 14, 2004

(30) Foreign Application Priority Data

Aug. 6, 2001 (CN) ..... 01 2 32814

(51) Int. Cl.
*B65D 88/36* (2006.01)

(52) U.S. Cl. ..... 220/218; 220/216; 220/222; 220/578

(58) Field of Classification Search ..... 220/218, 220/216, 221, 222, 578, 225, 226
See application file for complete search history.

(56) References Cited

U.S. PATENT DOCUMENTS

| | | | | |
|---|---|---|---|---|
| 1,913,643 | A * | 6/1933 | Smith | 220/224 |
| 1,928,905 | A * | 10/1933 | Meyers | 220/219 |
| 2,672,409 | A * | 3/1954 | Perkins | 48/177 |
| 3,134,501 | A * | 5/1964 | Bodley | 220/218 |
| 3,288,322 | A * | 11/1966 | Marshall et al. | 220/226 |
| 3,343,708 | A * | 9/1967 | Haas | 220/225 |
| 3,462,040 | A * | 8/1969 | Galloway | 220/218 |
| 3,493,143 | A * | 2/1970 | Thompson et al. | 220/218 |
| 3,910,452 | A * | 10/1975 | Szasz | 220/226 |
| 4,014,454 | A * | 3/1977 | Nayler et al. | 220/225 |
| 4,018,356 | A * | 4/1977 | Szasz et al. | 220/220 |
| RE29,270 | E * | 6/1977 | Nelson | 220/220 |
| 4,213,280 | A * | 7/1980 | Sandborn | 52/309.9 |

(Continued)

FOREIGN PATENT DOCUMENTS

WO WO A-95/03687 2/1995

*Primary Examiner*—Anthony Stashick
*Assistant Examiner*—Christopher B. McKinley
(74) *Attorney, Agent, or Firm*—Armstrong, Kratz, Quintos, Hanson & Brooks, LLP

(57) ABSTRACT

The present invention relates to an oil storage tank equipped with a floating bed type inner floating roof. The oil storage tank structure has a tank body and an inner floating roof which lies on the liquid surface inside the tank. The inner floating roof includes filling bags and a resilient sealing tube. The filling bags, separated by isolation sheets, are filled with floating plates. The resilient sealing tube is disposed around the entire circumference of the filling bags, and is in contact with and biased against the inner wall of the tank body.

3 Claims, 4 Drawing Sheets

U.S. PATENT DOCUMENTS 4,493,430 A * 1/1985 Sie ..... 220/224
5,005,724 A * 4/1991 Imhof ..... 220/222
5,123,559 A * 6/1992 Qiu et al. ..... 220/218
5,305,904 A * 4/1994 Cutts ..... 220/220
5,490,605 A * 2/1996 Cutts ..... 220/211
5,704,509 A * 1/1998 Rosenkrantz ..... 220/216
6,193,092 B1 * 2/2001 Witter ..... 220/218
2004/0188438 A1 * 9/2004 King et al. ..... 220/218

* cited by examiner

OIL STORAGE TANK EQUIPPED WITH A FLOATING BED TYPE INNER FLOATING ROOF

TECHNICAL FIELD

The present invention relates to an oil storage tank equipped with a floating bed type inner floating roof, it is within the technical field of petrochemical facility.

BACKGROUND OF THE INVENTION

At present, as it is shown in the patents of utility model ZL93217054.4 and ZL97239243.2, the oil storage tank with inner floating roof adopts I-shaped or circular components, which are usually processed from steel plate or aluminum plate. These components are constructed into derivative frame network structure by bolts or aluminum rivets, in which a foamed plastic float covered by metallic layer, or a seamless floating tube extruded by aluminum alloy is fixed. A steel plate or aluminum plate is covered at the top of the derivative frame as a cover board, whose edge is sealed with ligulae or wave sealing strip. The inner floating roof is connected with the top of the oil storage tank by a metal lead in order to induce to static electricity. The disadvantage of the present technology are as follow: the complicated structure will result in too much workload when it is locally assembled; its heavy weight with unequally distributed buoyancy which is only 2 to 3 times of its weight will probably result in tumble accident; the whole metal structure of the inner floating roof setting will probably result in the electrostatic damage; the great thickness of the inner floating roof is usually between 100 mm and 400 mm, enlarges the ineffective pace in the oil storage tank's capacity.

SUMMARY OF THE INVENTION

It is, therefore, the object of the present invention to invent a oil storage tank with floating bed type inner floating roof, in order to modify the construction of the prior art, to reduce the amount of metallic components used in the inner floating roof, to lower the weight of the inner floating roof, to increase the buoyant force, to eliminate the risk of tumble accident and electrostatic damage, and to reduce the ineffective space occupied by inner floating roof, within the oil storage tank's capacity.

The oil storage tank equipped with a floating bed type inner floating roof of the present invention comprises a tank body and an inner floating roof which lies on the liquid surface inside the tank. The inner floating roof includes filling bags and a resilient sealing tube. The filling bags are filled with floating plates separated by isolating sheets. The resilient sealing tube is disposed around the entire circumference of the filling bags, and is in contact with and compressed against the inner wall of the tank body.

The above filling bags of the oil storage tank is mated from many filling bags by the connecting parts and fixing parts, and then becomes a flat plate having a same shape as the inner section of the tank body.

In addition, the oil storage tank of the present invention comprises a fixed bracket to hold the inner floating roof. The fixed bracket placed at the inside bottom of the tank body is composed of bracket, triangular pyramid bearing frame and supporting legs. The bracket consists of a circular annulation and a cross network located inside the circular annulation, the diameter of which is smaller than the inside diameter of the tank body. The bottom surface of the triangular pyramid bearing frame is put on the bracket. One end of the supporting leg is fixed at the crunodes of the cross network.

The oil storage tank equipped with a floating bed type inner floating roof of the present invention has the following advantages: 1. It is simple in structure since the filling bags can be treated as a whole flat body with the same shape as the inner section of oil storage tank, when it is locally assembled, what needs to be done is to insert the floating plate into the filling bag one-by-one which was already there, then seal the bag and fix the resilient sealing tube with the edge of the filling bag. If the filling bags are not a whole flat body, it is necessary to mate several filling bags together by the connecting parts and fixing parts, and make it a flat plate with the same shape as that of the inner section of the tank, and then fix the resilient sealing tube with the edge of the filling bags. 2. Due to the reduced amount of the metallic components used in the inner floating roof, its weight is lowered and the buoyancy of the inner floating roof is 6–12 times of the weight of the whole body. Furthermore, the buoyancy is evenly distributed over the liquid surface of oil storage tank, thus the risk of tumble accident dose not exist. 3. Since the inner floating roof is made of oil resistant rubber fabric, which is electrically insulating, the risk of electrostatic damage is avoided. 4. With the thickness of the inner floating roof being reduced, the effective capacity of the oil storage tank can be enlarged.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

From FIG. 1 to FIG. 7, 1 refers to the filling bag, which can be made of oil resistivity rubber fabric; 2 refers to the floating plate filled in the filling bag, which can be made from polyethylene foamed plastics; 3 refers to the isolating sheet in the filling bag, which can be made of oil resistant rubber fabric; 4 refers to the oil-filled resilient sealing tube, which can be made of oil resistant elastic rubber; 5 refers to the connecting part for mating filling bags together, which can be made of angle-aluminum material; 6 refers to the fixing part for connecting the connecting parts, such as rivet or screw; 7 refers to the tank body of the oil storage tank; 8 refers to the fixed bracket for holding the inner floating roof, which can be made of structural section aluminum; 9 refers to the supporting leg of the fixed bracket; 10 refers to the triangular pyramid bearing frame, which can be made of structural section aluminum; 11 refers to the oil resistant rubber tube; 12 refers to the oil resistant rubber fabric as a connecting part; 13 refers to the wear-resistant and oil resistant rubber piece; 14 refers to the binder.

BEST MODE FOR CARRYING OUT THE INVENTION

Figure 1:
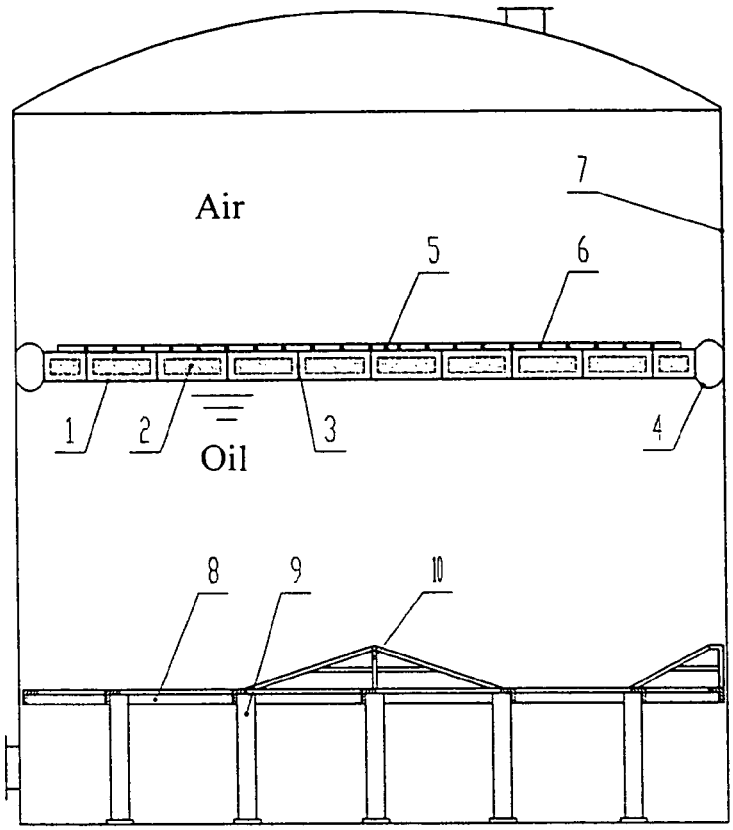
FIG. 1 illustrates the structure of the oil storage tank equipped with a floating bed type inner floating roof according to the present invention.
Figure 2:
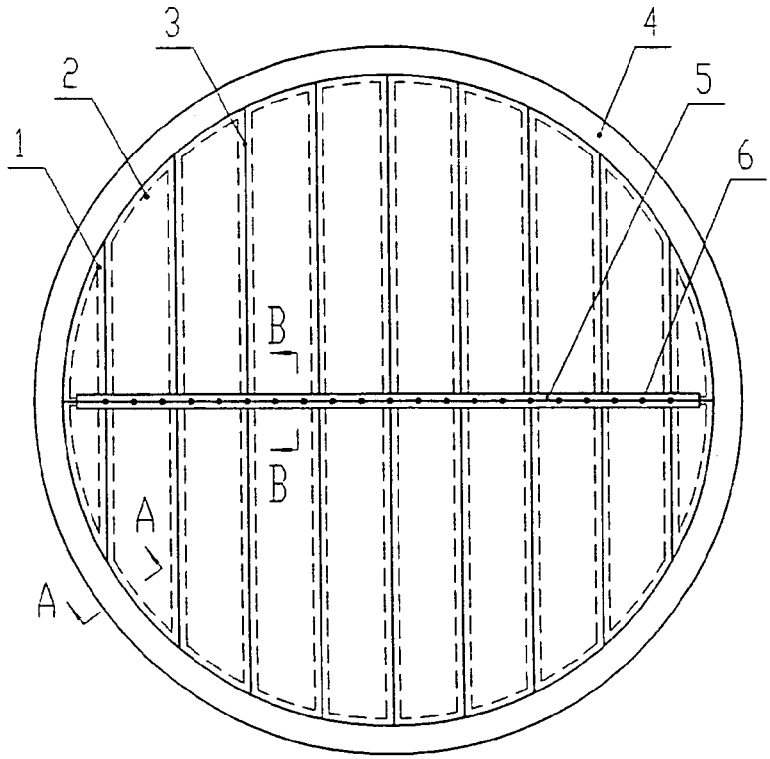
FIG. 2 is an overlook elevational view of the inner floating roof as shown in FIG. 1.

According to the present invention, FIGS. 1 and 2 depict an oil storage tank equipped with a floating bed type inner floating roof, including a tank body 7 and an inner floating roof which lies on the liquid surface inside the tank. The inner floating roof includes filling bags 1 and a resilient sealing tube 4. The filling bags are filled with buoyant plates 2 separated by isolating sheets 3. The resilient sealing tube 4 is disposed around the entire circumference of the filling bags 1 after they have been mated together. The resilient sealing tube 4 is filled with the same liquid, which is oil, as is inside the tank. The resilient sealing tube 4 filled with liquid is in contact with and biased against the inner wall of the tank body since the size of the floating bed type inner floating roof is bigger than the size of the inner wall of oil storage tank. Therefore, the oil in the tank will be isolated from the air.

Figure 3:
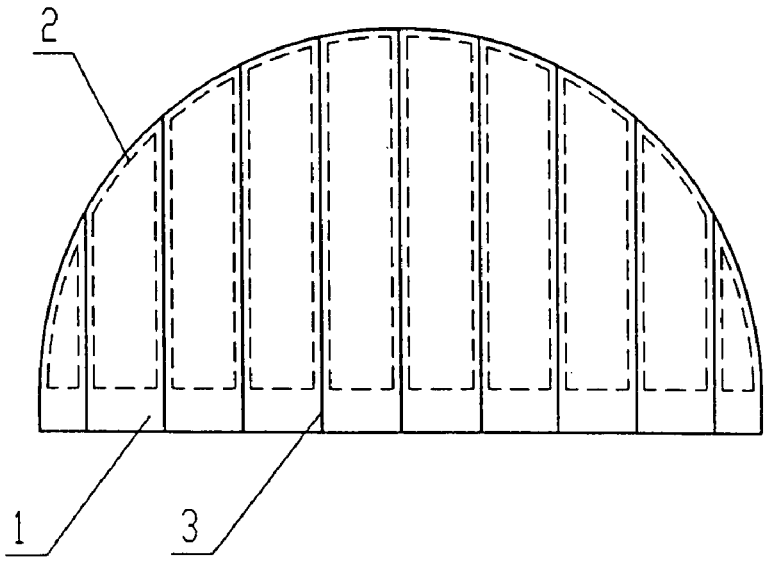
FIG. 3 is an overlook elevational view of the filling bags filled with floating plates as shown in FIG. 2.

As shown in FIG. 3, the filling bags 1 of the oil storage tank can be mated from many filling bags connected by the connecting parts 5 and fixing parts 6.

In addition, the oil storage tank of the present invention comprises a fixed bracket, as shown in FIG. 1, to hold the inner floating roof. The fixed bracket placed at the inside bottom of the tank body 7 is composed of a bracket 8, triangular pyramid bearing frame 10 and a supporting leg 9. The bracket 8 comprises a circular annulation and a cross network placed inside the circular annulation, the diameter of which is smaller than the inside diameter of the tank body. The bottom surface of the triangular pyramid bearing frame is put on the bracket. One end of the supporting leg is fixed at the crunodes of the cross network.

Figure 7:
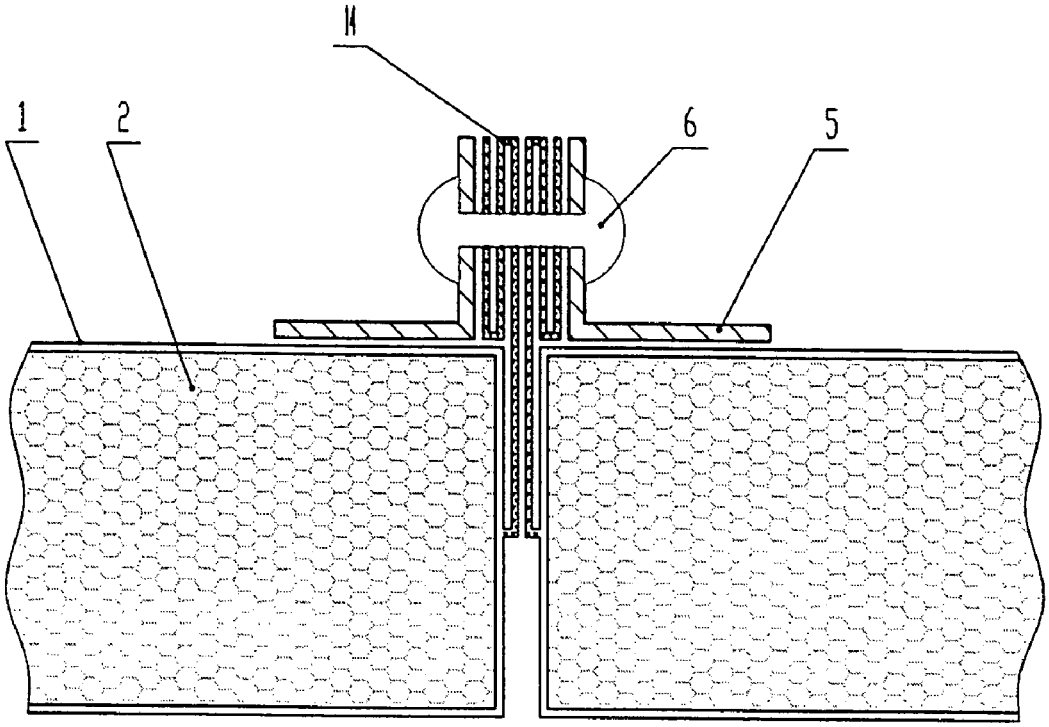
FIG. 7 is an enlarged sectional view taken along the line B—B in FIG. 2.

As shown in FIG. 3, the filling bags 1 of the oil storage tank according to the present invention, can be prepared by circular, hemi-circular, or other segmentation method with the same thickness everywhere based on different shape and dimension of the inner section of the oil storage tank. Plural parallel floating plate filling bags are designed from a plurality of individual filling bags each inserted with a floating plate. Each bag is kept open in one end, and is separated from each other by fixing isolating sheets 3. The filling bag should be tightly sealed. The floating plate 2 is made based on the shape of the end port of each bag, then put into the filling bags. Finally the filling bags are sealed by coating the binder 14 uniformly on the inside of filling bags which is longer than the end port. After being sealed, each floating plate filling bag is strictly isolated from outside and from each other in order to prevent the outside air and oil from entering into the filling bags. The thickness of floating plate 2 is uniform everywhere. And the floating plate should be made from the material with higher density and higher intensity so that it is able to keep the floating bed type inner floating roof as the same shapes as was designed originally. The filling bags are mated into a flat plate with the same shape as the inner section of the tank body 7, and are filled with floating plate 2. If the filling bags 1 is not a flat plate with the same shape as the inner cross section of the oil storage tank body, it is necessary to put several filling bags together to make it a whole body. FIG. 7 shows an enlarged sectional view of the place where two filling bags are mated together. The specific operations are: the longer part of final encapsulation of the filling bag 1 is folded up into multi layers, then pressed together with the final encapsulation of another filling bags which is also folded up into multi layers. Each end of the encapsulation is clamped by the connecting part 5. The two encapsulations are put together by the fixing part 6, to make sure the rigorousness and reliability of the connection between each floating plate filling bag.

Figure 4:
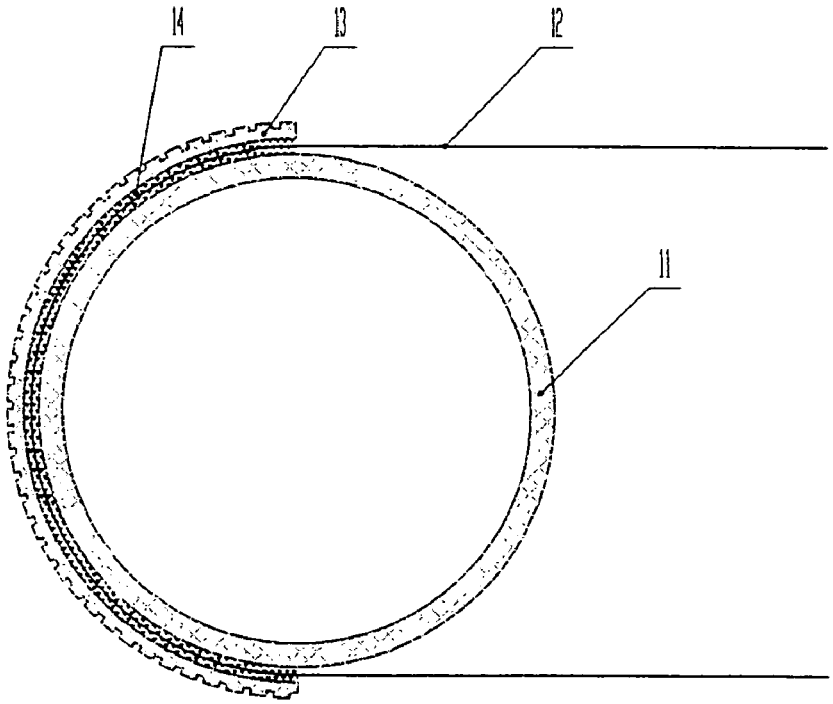
FIG. 4 is an enlarged section view of the oil-filled sealing tube as shown in FIG. 2.
Figure 6:
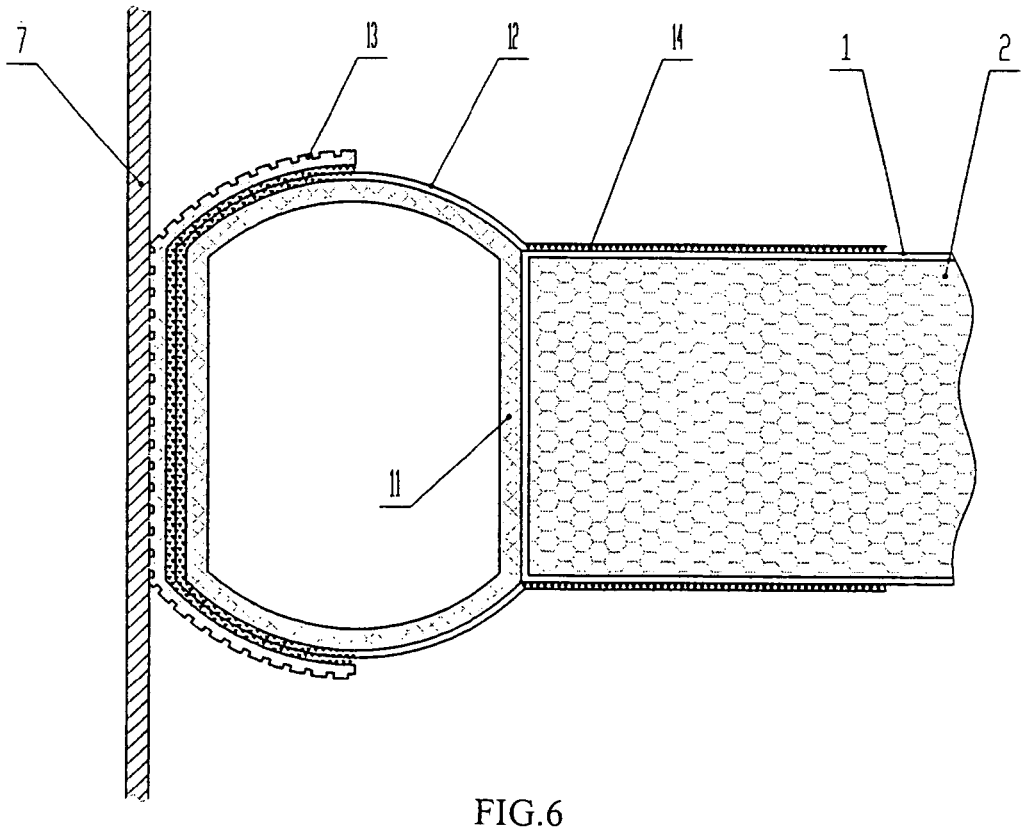
FIG. 6 is an enlarged sectional view taken along the line A—A in FIG. 2.

The resilient sealing tube 4 is disposed around the entire circumference of the filling bags 1 by the oil resistant rubber fabric 12, as shown in FIG. 4 and FIG. 6. The first step is to select elastic oil resistant rubber tube as resilient sealing tube. The oil resistant rubber fabric 12 is fixed at the half of the circumference outside of the oil resistant rubber tube 4 by binder 14. At each end of the rubber fabric, a longer part is saved in advance as an agraffe for connecting the resilient sealing tube 4 with filling bags 1 together into a whole body. At the inner wall contact area between the resilient sealing tube 4 and the tank body 7, the resilient sealing tube 4 is bonded with a wear-resistant and oil resistant rubber piece 13 along half of the circumference by the binder 14, to prevent the resilient sealing tube from breaking and becoming ineffective due to long-term wear and tear. The resilient sealing tube 4 is filled with oil that is the same as inside the oil tank. The resilient sealing tube 4 is in contact with and biased against the inner wall of the tank body 7 to realize isolation. Therefore, a floating bed type inner floating roof is completed. It can cover the entire oil surface inside the oil storage tank, and therefore prevent the light component of the stored oil from volatilizing to the area above the oil surface.

FIG. 6 shows an enlarged sectional view of the connecting area of the resilient sealing tube 4 and floating plate filling bag 1. The prepared resilient sealing tube 4 is fixed, by binder 14, along the outside circumference of the floating plate filling bag 1, and then is filled with the same oil as in the tank. The diameter of oil-filled resilient sealing tube 4 is designed to be a little bigger than the thickness of the filling bag 1, while the outside diameter of inner floating roof is designed to be a little bigger than the inside diameter of tank body. The value of their difference is equal to the diameter of resilient sealing tube in order to make sure that there is an extrusion force between the resilient sealing tube 4 and the tank body 7. Therefore the resilient sealing tube 4 is sealed off tank body 7.

Figure 5:
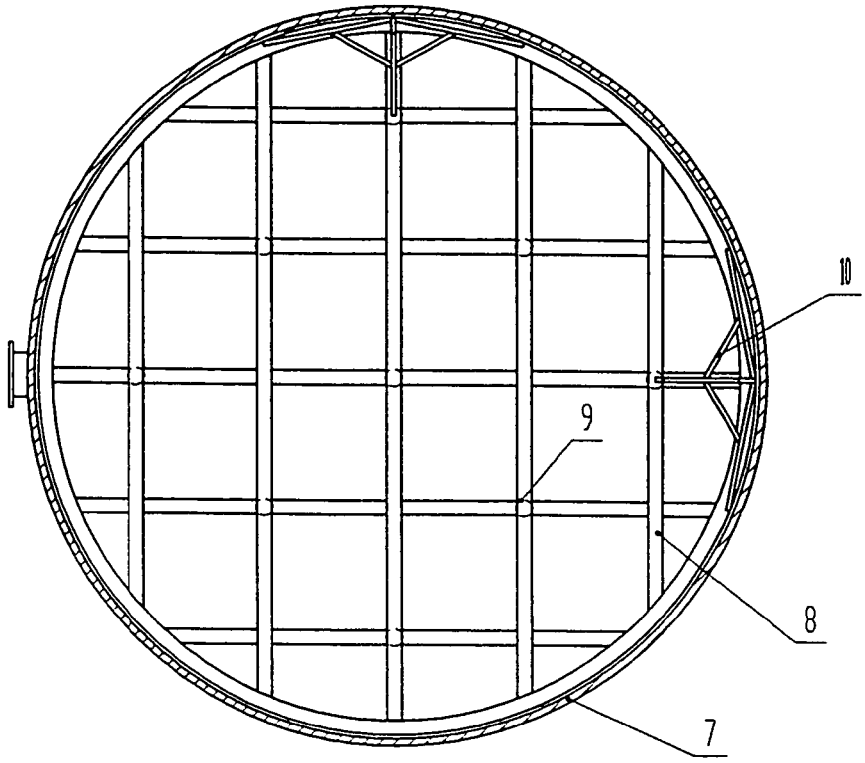
FIG. 5 is an overlook elevational view of the fixed bracket of the inner floating roof as shown in FIG. 1.

FIG. 5 depicts the fixed bracket 8 of the inner floating roof of the oil storage tank according to the present invention. The fixed bracket 8 for holding the inner floating roof, the supporting leg 9 of the fixed bracket and the triangular pyramid bearing frame 10 are made of structural section aluminum, and are put at the bottom of tank. When the inner floating roof is constructed upon the fixed bracket 8, the triangular pyramid bearing frame 10 will not be assembled until the construction of the inner floating roof is finished, i.e. the resilient sealing tube 4 is filled with liquid and sealed. The functions of the fixed bracket 8 for holding the inner floating roof are as follows: 1, it can provide an installation platform for the inner floating roof; 2, when the liquid level is below the fixed bracket 8, the fixed bracket will support the inner floating roof, so that the inner floating roof can not fall down to affect the normal work of the other component. The functions of the triangular pyramid bearing frame 10 are as follows: when the liquid level is below the fixed bracket 8, and before the inner floating roof falls onto the fixed bracket 8, the triangular pyramid bearing frame 10 which is fixed at the edge of the fixed bracket 8 will contact the inner floating roof, and support the edge of inner floating roof, as a result the inner floating roof will not contact the tank body 7. Therefore the negative pressure under the inner floating roof will be prevented.

What is claimed is:

1. An oil storage tank equipped with a floating bed type inner floating roof comprises a tank body and an inner floating roof which lies on the liquid surface inside the tank; said inner floating roof includes filling bags and a resilient sealing tube, said filling bags are filled with floating plates and are separated by isolating sheets, said resilient sealing tube is disposed around the entire circumference of the filling bags, and is in contact with and biased against the inner wall of the tank body.

2. The oil storage tank of claim 1, wherein said filling bags are mated from many filling bags by connecting parts and fixing parts, becoming a flat plate with the same shape as the inner section of the tank body.

3. The oil storage tank of claim 1, comprises a fixed bracket for holding the inner floating roof, said fixed bracket is located at the inside bottom of the tank body, said fixed bracket comprises bracket, triangular pyramid bearing frame and supporting leg, said bracket comprises a circular annulation and a cross network, said cross network is located inside said annulation, and the diameter of said annulation is smaller than the inside diameter of said tank body, the bottom surface of said triangular pyramid bearing frame is located on the bracket, one end of said support leg is fixed at the crunodes of said cross network.

* * * * *